US011751600B2

(12) United States Patent
Ahn

(10) Patent No.: US 11,751,600 B2
(45) Date of Patent: Sep. 12, 2023

(54) CONE LOADING DEVICE AND METHOD THEREFOR

(71) Applicant: KNT CO., LTD, Daejeon (KR)

(72) Inventor: Sang Geun Ahn, Phoenix, AZ (US)

(73) Assignee: KNT CO., LTD, Daejeon (KR)

( * ) Notice: Subject to any disclaimer, the term of this patent is extended or adjusted under 35 U.S.C. 154(b) by 90 days.

(21) Appl. No.: 16/703,256

(22) Filed: Dec. 4, 2019

(65) Prior Publication Data

US 2021/0169133 A1 Jun. 10, 2021

(51) Int. Cl.

| | |
|---|---|
| ***A24C 5/08*** | (2006.01) |
| ***A24C 5/06*** | (2006.01) |
| ***A24C 5/00*** | (2020.01) |
| ***A24C 1/02*** | (2006.01) |
| ***A24C 1/28*** | (2006.01) |
| ***A24C 5/39*** | (2006.01) |
| ***A24C 1/44*** | (2006.01) |

(52) U.S. Cl.

CPC ..... *A24C 5/08* (2013.01); *A24C 1/02* (2013.01); *A24C 1/28* (2013.01); *A24C 1/44* (2013.01); *A24C 5/002* (2013.01); *A24C 5/06* (2013.01); *A24C 5/39* (2013.01)

(58) Field of Classification Search

CPC .... A24B 7/04; A24B 7/14; A24C 5/42; A24C 5/02; A24C 5/06; A24C 5/40; A24C 5/44; A24C 5/08; A24C 1/02; A24C 1/28; A24C 1/44; A24C 5/002; A24C 5/39

See application file for complete search history.

(56) References Cited

U.S. PATENT DOCUMENTS 10,028,618 B1 7/2018 Benson
2013/0228187 A1* 9/2013 Yisha ..... A24C 5/02 131/108

(Continued)

FOREIGN PATENT DOCUMENTS

WO WO-2017172844 A1 * 10/2017 ..... A24D 1/18
WO 2019092477 5/2019

OTHER PUBLICATIONS

Hefestus Technologies Ltd, "Hefestus Cone Rolling Robot", youtube.com, https://youtu.be/zPQKkSIfcBU, accessed Jun. 27, 2022 (Year: 2018).*

(Continued)

*Primary Examiner* — Kelly M Gambetta
*Assistant Examiner* — Stephanie Lynn Moore
(74) *Attorney, Agent, or Firm* — Weiss & Moy, PC; Jeffrey D. Moy

(57) ABSTRACT

A device for automated loading and forming smoking articles has a pre-rolled cone holder holding a plurality of pre-rolled cones. A loading mechanism loads individual pre-rolled cones in the pre-rolled cone holder with a predefined amount of material. A filling mechanism deposits the predefined amount of material in the loading mechanism, the filling mechanism monitoring an amount of material loaded in the filling mechanism and sending a signal to stop loading the filling mechanism with the material when a predefined amount has been loaded. A dispensing mechanism sends the material to the filling mechanism. A hopper is in communication with the dispensing mechanism storing the material. A shaker is coupled to the hopper shaking the material in the hopper preventing the material from sticking together.

19 Claims, 9 Drawing Sheets

(56) References Cited

U.S. PATENT DOCUMENTS

| | | | | |
|---|---|---|---|---|
| 2015/0298135 | A1 | 10/2015 | Speilman | |
| 2016/0029691 | A1 | 2/2016 | Ruzycky | |
| 2018/0213838 | A1 | 8/2018 | Richmond et al. | |
| 2018/0338642 | A1 | 11/2018 | Staiano et al. | |
| 2018/0344086 | A1 | 12/2018 | McDonough | |
| 2019/0269277 | A1 | 9/2019 | Larose | |
| 2019/0329514 | A1* | 10/2019 | Holderman | A24C 5/06 |
| 2020/0068947 | A1* | 3/2020 | Leadbeater | A24C 5/398 |
| 2021/0022388 | A1* | 1/2021 | Sullivan | A24C 5/02 |

OTHER PUBLICATIONS

Hefestus Technologies Ltd, "Cone Rolling Robot Demo Live from Hefestus Technologies , Caesarea, Israel", https://www.youtube.com/live/v0gZUSf2tp8?feature=share, accessed Jan. 27, 2023 (Year: 2019).*

* cited by examiner

CONE LOADING DEVICE AND METHOD THEREFOR

TECHNICAL FIELD

The present application relates generally to the technical field of tobacco and herbal smoking articles, and more specifically, to the technical field of a device to load and form a user determined number of smoking articles using preformed conical paper wrappers.

BACKGROUND

Hand rolling smoking articles, such as cigarettes and the like, is a well-known practice. In one process, rolling paper may be formed into a cone and used to scoop up small amounts of grounded smokable tobacco and/or herbs. The maker of the smoking article may then hold the open end of the cone upward allowing the small amount to fall into the cone. This process continues until a desired amount of grounded smokable tobacco and/or herbs is held within the cone. The maker may use a rod or similar object to compact the grounded smokable tobacco and/or herbs into the cone. This process is repeated until the cone is filled and compacted with the desired amount of grounded smokable tobacco and/or herbs. The open end of the cone is then sealed to prevent the materials from falling out thereby forming the smoking article.

Unfortunately, rolling individual smoking articles is time consuming. The time-consuming process is a major problem for manufacturers since it directly relates to the cost effectiveness which is critical aspect of revenue. Further, rolling individual smoking articles may cause inconsistency in the smoking articles. This may be due to the smoking articles being unevenly filled and/or compacted with the grounded smokable tobacco and/or herbs. Unevenly filling and/or compacting the grounded smokable tobacco and/or herbs may adversely affect burn rates and temperatures of the smoking articles. That, in turn, can adversely affect the smoke flavors and result in the generation of unwanted combustion byproducts during the material burn.

Presently, there are mechanical devices that may be used to load grounded smokable tobacco and/or herbs into pre-rolled cones. While these devices do work, there are some inherent issues. First, some grounded smokable tobacco and/or herbs have a tendency to clump together. The clumping of the grounded smokable tobacco and/or herbs may cause the devices to clog-up. The clogging of the device may cause uneven filling of the pre-rolled cones or worse, non-filling of the pre-rolled cones. Further, these devices do not proper compress the grounded smokable tobacco and/or herbs in the pre-rolled cones nor do they properly seal the pre-rolled cones once the pre-rolled cones are loaded with the grounded smokable tobacco and/or herbs.

Therefore, it would be desirable to provide a system and method that overcomes the above.

SUMMARY

In accordance with one embodiment, a device for automated loading and forming smoking articles is disclosed. The device has a pre-rolled cone holder holding a plurality of pre-rolled cones. A loading mechanism loads individual pre-rolled cones in the pre-rolled cone holder with a predefined amount of material. A filling mechanism deposits the predefined amount of material in the loading mechanism. The filling mechanism monitors an amount of material loaded in the filling mechanism and sends a signal to stop loading the filling mechanism with the material when a predefined amount has been loaded. A dispensing mechanism sends the material to the filling mechanism. The dispensing mechanism stops the sending of material when the filling mechanism sends the signal to stop loading the filling mechanism with the material when a predefined amount has been loaded. A hopper is in communication with the dispensing mechanism storing the material. A shaker is coupled to the hopper shaking the material in the hopper preventing the material from sticking together.

In accordance with one embodiment, a device for automated loading and forming smoking articles is disclosed. The device has a pre-rolled cone holder holding a plurality of pre-rolled cones. A loading mechanism loads individual pre-rolled cones in the pre-rolled cone holder with a predefined amount of material. A compacting mechanism compresses the predefined amount of material loaded into each of the pre-rolled cones. A sealing mechanism compresses an open end of each of the pre-rolled cones preventing the material loaded into each of the pre-rolled cones from falling out. A filling mechanism deposits the predefined amount of material in the loading mechanism. The filling mechanism monitors an amount of material loaded in the filling mechanism and sends a signal to stop loading the filling mechanism with the material when a predefined amount has been loaded. A dispensing mechanism sends the material to the filling mechanism. The dispensing mechanism stops sending of material when the filling mechanism send the signal to stop loading the filling mechanism with the material when a predefined amount has been loaded.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLCIATION

Figure 1:
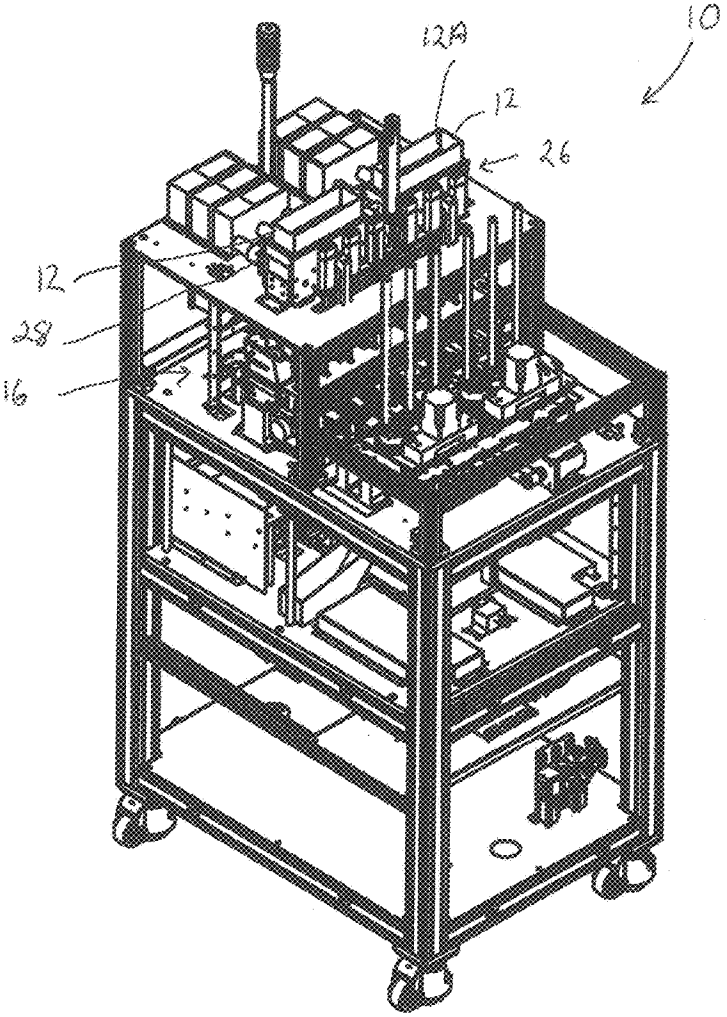
FIG. 1 is an elevated perspective view of an exemplary cone loading and forming device in accordance with one aspect of the present application.
Figure 2:
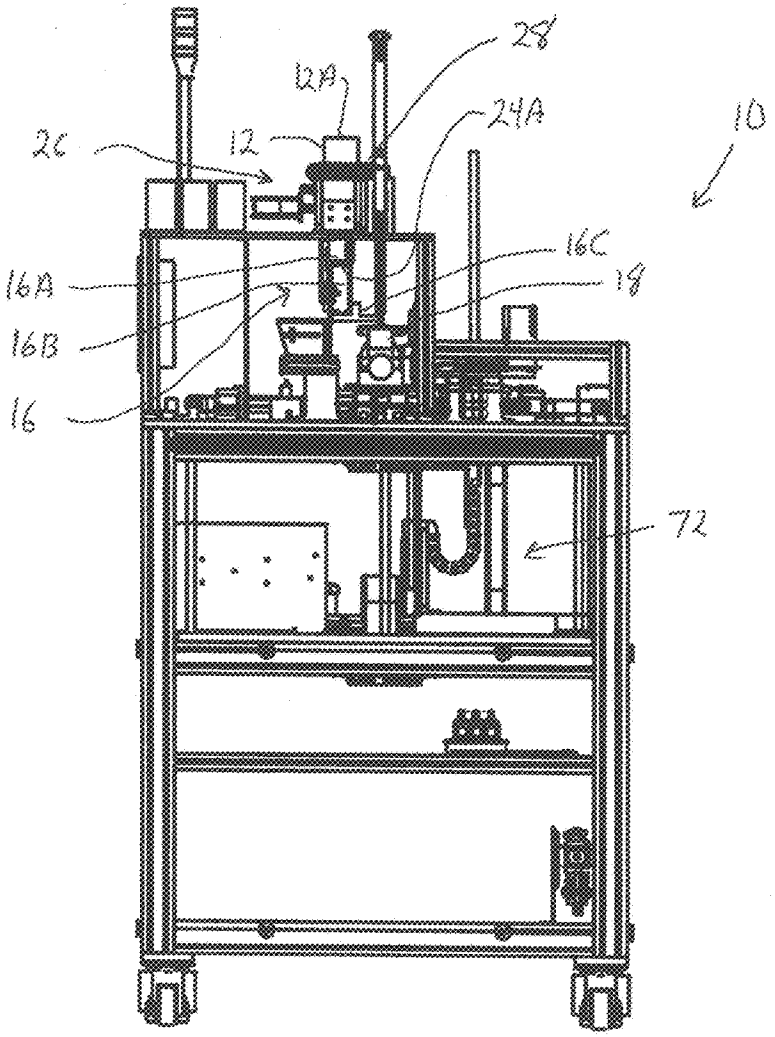
FIG. 2 is side view of the exemplary cone loading and forming device in accordance with one aspect of the present application.
Figure 3:
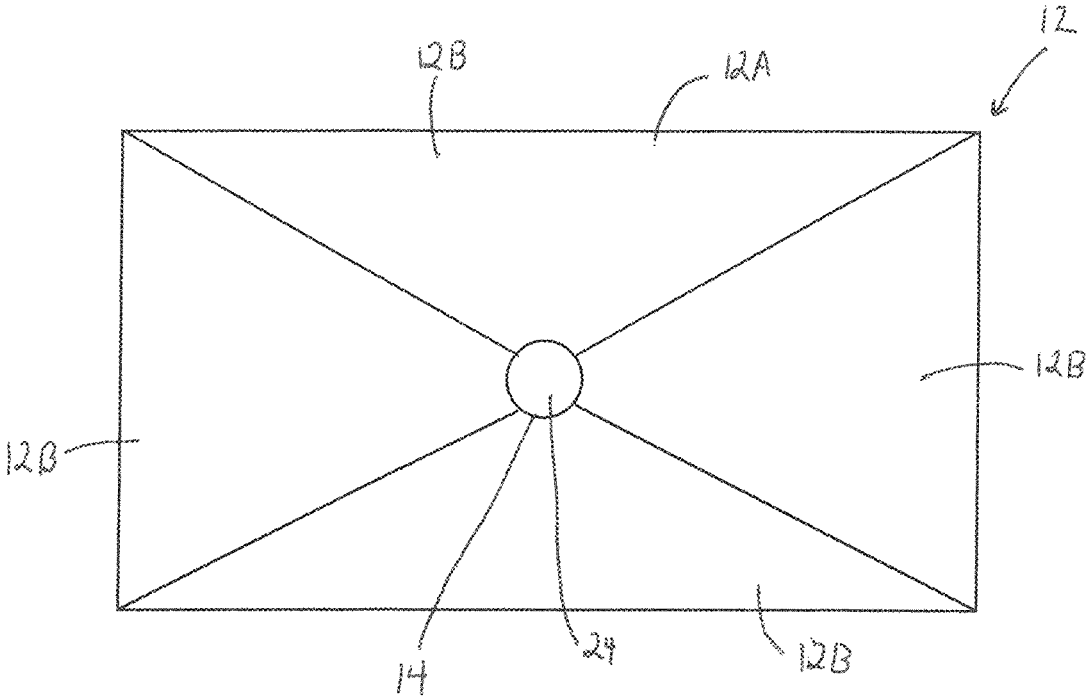
FIG. 3 is a magnified top view of an exemplary hopper used in the cone loading and forming device of FIGS. 1 and 2 in accordance with one aspect of the present application.
Figure 4A:
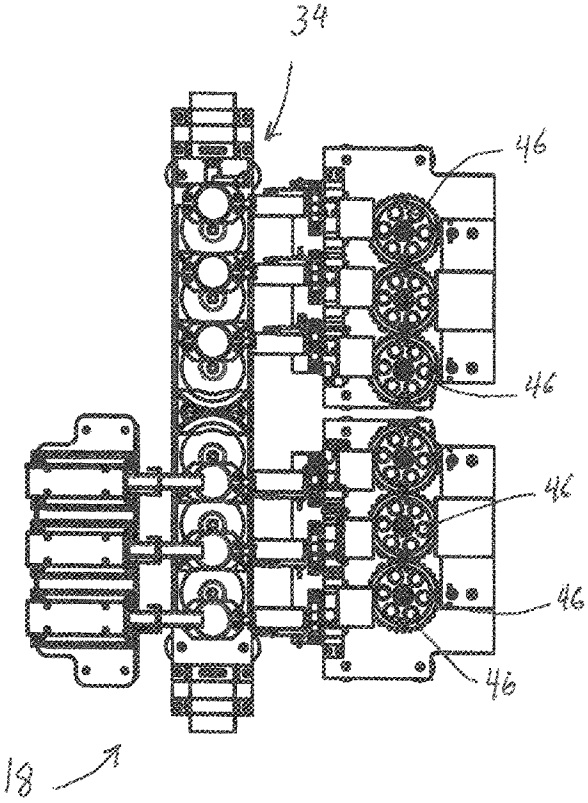
FIG. 4A is a top view of exemplary filling and loading mechanisms used in the cone loading and forming device of FIGS. 1 and 2 in accordance with one aspect of the present application.
Figure 4B:
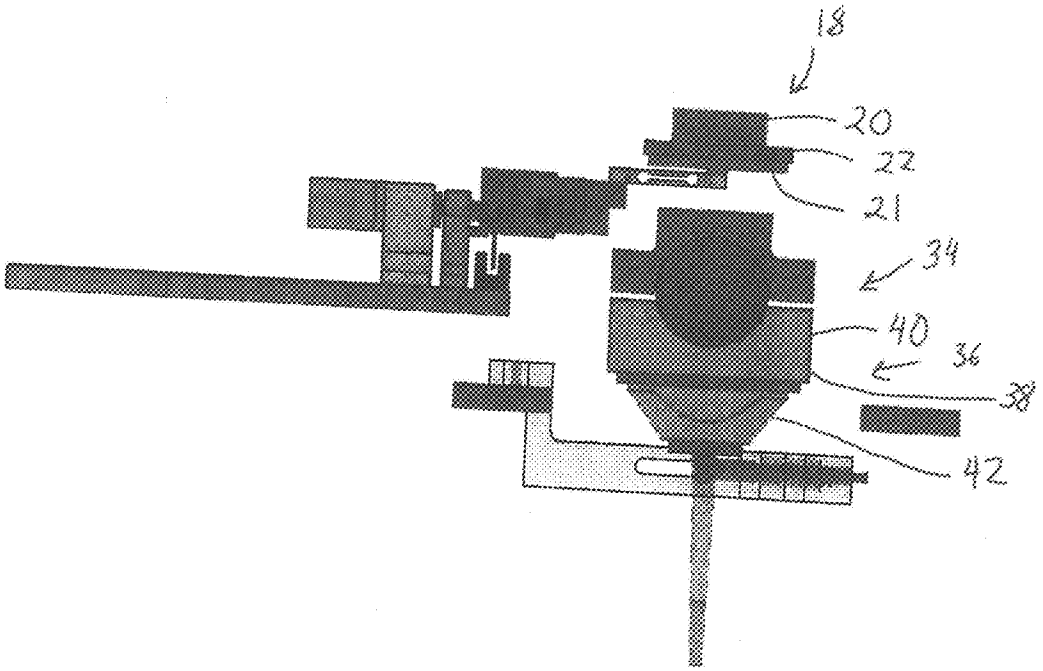
FIG. 4B is a side view of an individual exemplary filling and loading mechanisms used in the cone loading and forming device of FIGS. 1 and 2 in accordance with one aspect of the present application.
Figure 5:
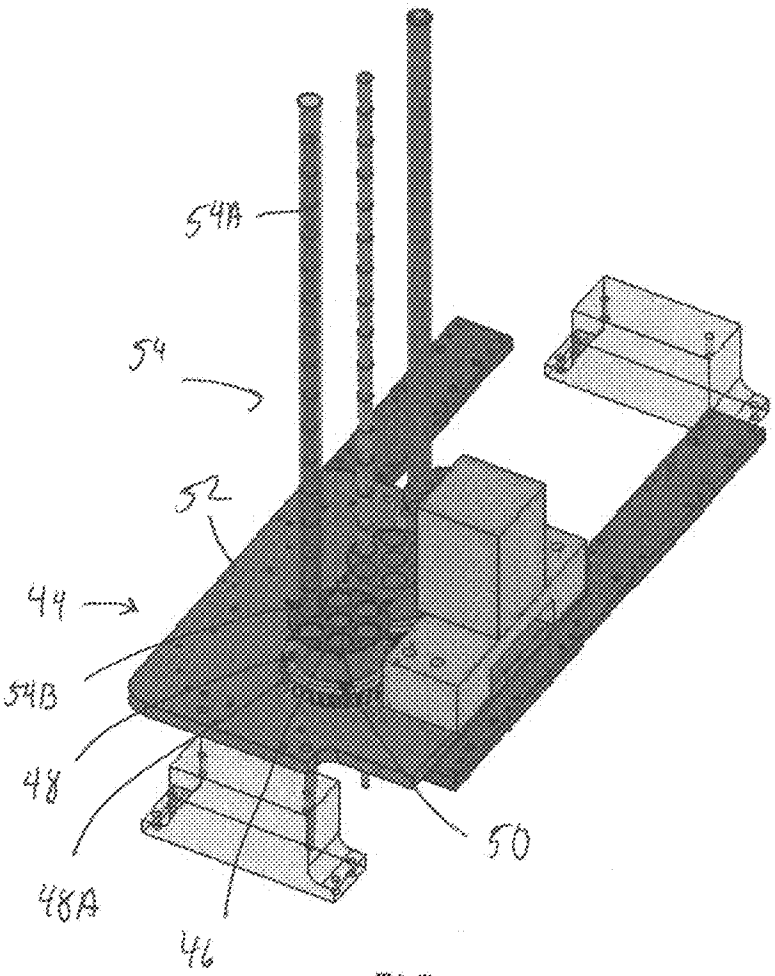
FIG. 5 is an elevated perspective view of exemplary pre-rolled cone loading mechanisms used in the cone loading and forming device of FIGS. 1 and 2 in accordance with one aspect of the present application.
Figure 6A:
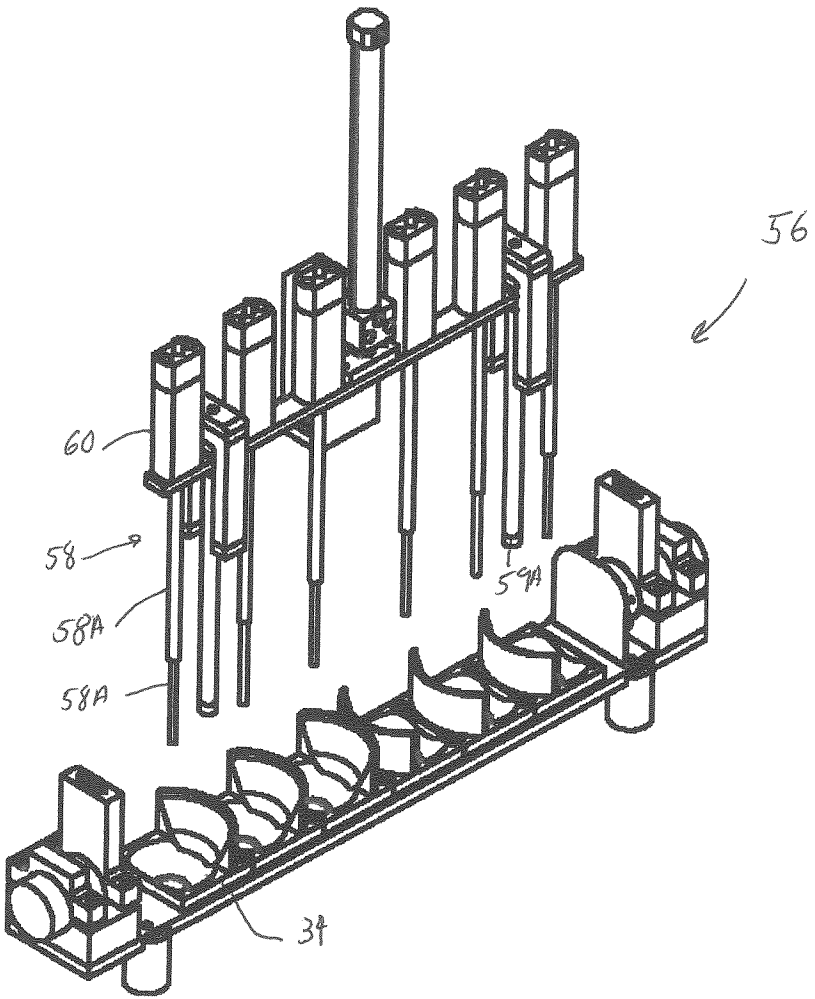
FIG. 6A is an elevated perspective view of exemplary compacting mechanisms used in the cone loading and forming device of FIGS. 1 and 2 in accordance with one aspect of the present application.
Figure 6B:
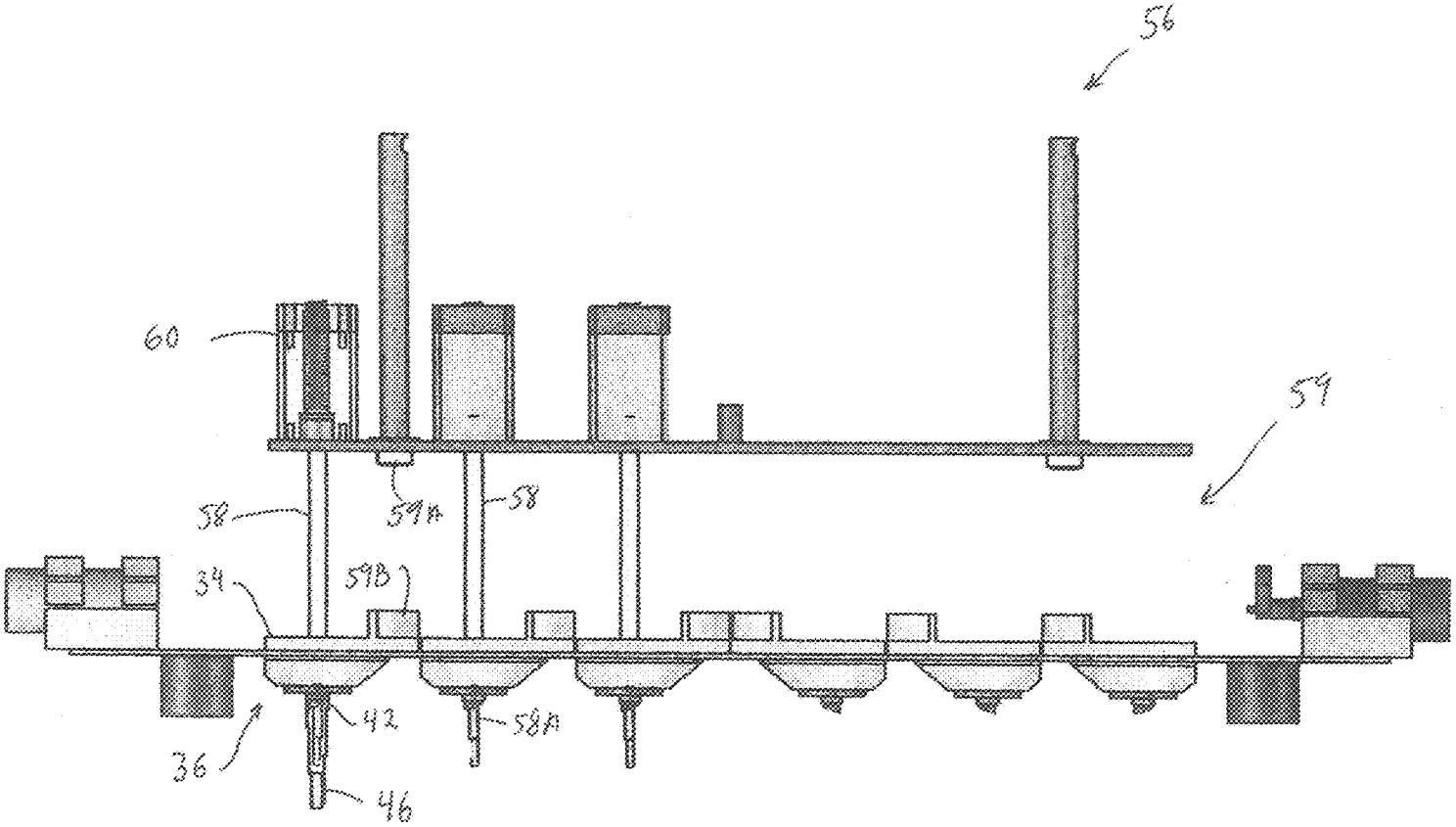
FIG. 6B is a side view of the exemplary compacting mechanisms shown in FIG. 6A with several of the compacting mechanism removed and guide rails retracted in accordance with one aspect of the present application.
Figure 7B:
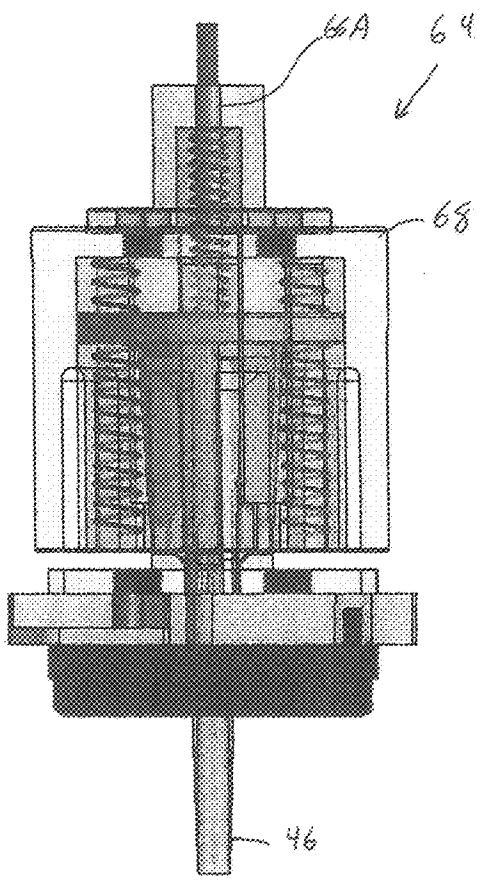
FIG. 7B is a side view of the exemplary sealing mechanisms shown in FIG. 7A closing an open end of a smoking article in accordance with one aspect of the present application.
Figure 7A:
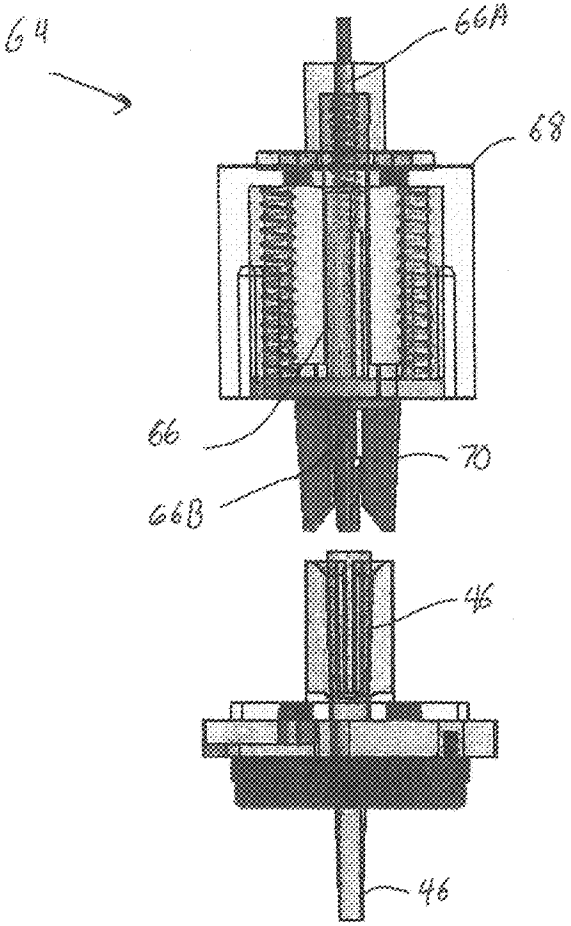
FIG. 7A is a side view of exemplary sealing mechanisms used in the cone loading and forming device of FIGS. 1 and 2 in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

The present disclosure relates to a device to load and form smoking articles using preformed conical paper wrappers. The device allows a user to select the number of smoking articles to form. The device is able to prevent clumping and separates any type of grounded smokable tobacco and/or herbs to allow even filling of the pre-rolled cones. The device is able to compact the grounded smokable tobacco and/or herbs in the pre-rolled cones and properly seal the pre-rolled cones once the pre-rolled cones are loaded with the grounded smokable tobacco and/or herbs.

Referring to the FIGs., a device 10 may be seen for loading preformed conical paper wrappers 12 with grounded smokable tobacco and/or herbs. The device 10 may have one or more hoppers 12. The hopper 12 may be used to store and dispense the grounded smokable tobacco and/or herbs. The hopper 12 may be container having an open top area 12A. The open top area 12A may allow one to load the grounded smokable tobacco and/or herbs into the hopper 12. In the present embodiment, the hopper 12 may have a rectangular configuration. However, this is shown as an example and should not be seen in a limiting manner. The hopper 12 may come in other geometrical configurations without departing from the spirt and scope of this invention.

An interior area of the hopper 12 may have sloping interior wall 12B. The sloping interior walls may help to funnel the grounded smokable tobacco and/or herbs in the hopper 12 towards one or more openings 14. The openings 14 may allow the hopper 12 to dispense the grounded smokable tobacco and/or herbs from the hopper 12.

A dispensing mechanism 16 may be in communication with each opening 14 of the hopper 12. The hopper 12 may deposits the grounded smokable tobacco and/or herbs into each of the dispensing mechanisms 16. The dispensing mechanisms 16 may then be used to deliver the grounded smokable tobacco and/or herbs from the hopper 12 to a desired destination.

In accordance with one embodiment, each dispensing mechanism 16 may have a chamber 16A. The chamber 16A may be located below the opening 14. The grounded smokable tobacco and/or herbs may be delivered from the hopper 12 through the opening 14 to the chamber 16A. An expelling device 16B may force the grounded smokable tobacco and/or herbs out of the chamber 16A and down a channel 16C to a filling mechanism 18. In accordance with one embodiment, the expelling device 16B may be an air piston, air value or the like which may use air to dispense the grounded smokable tobacco and/or herbs out of the chamber 16A and down the channel 16C. The use of air to dispense the grounded smokable tobacco and/or herbs out of the chamber 16A may also help to prevent the grounded smokable tobacco and/or herbs from clumping together. It should be noted that the above are given as examples and should not be seen in a limiting manner. Other types of expelling devices 16B may be used without departing from the spirit and scope of the present invention.

The filling mechanism 18 may be positioned at the distal end of the channel 16C. The dispensing mechanism 16 may load the filling mechanism 18 with a predetermined amount of the grounded smokable tobacco and/or herbs. The filling mechanism 18 may then be used to transfer the grounded smokable tobacco and/or herbs from the dispensing mechanism 16 to a pre-rolled cone 46 as discussed below.

The filling mechanism 18 may be configured to dispense a predefined amount of the grounded smokable tobacco and/or herbs from the chamber 16A of the dispensing mechanism 16. This may ensure that all smoking articles produced by the device 10 may have approximately the same amount of grounded smokable tobacco and/or herbs. This may provide consistency in the product produced by the device 10.

The filling mechanism 18 may have a container 20. The container 20 may be movably positioned at the distal end of the channel 16C. The container 20 may be used to collect the grounded smokable tobacco and/or herbs being dispensed from the channel 16C via the chamber 16A. The container 20 may be positioned on a movable platform 21. The movable platform 21 may allow the device 10 to position the container under the distal end of the channel 16C and to dispense the grounded smokable tobacco and/or herbs stored in the container 20 when a predetermined amount of the grounded smokable tobacco and/or herbs has been dispensed into the container 20.

The container 20 may be positioned on a sensor 22. The sensor 22 may be used to monitor the amount of the grounded smokable tobacco and/or herbs being dispensed into the container 20. Once the predefined amount of the grounded smokable tobacco and/or herbs has been dispensed into the container 20, the sensor 22 may signal the expelling device 16B to stop sending the grounded smokable tobacco and/or herbs down the channel 16C to the container 20.

In accordance with one embodiment, a cover 24 may be positioned over the opening 14 in the hopper 12. The cover 24 may be movable to allow the grounded smokable tobacco and/or herbs to be dispensed from the hopper 12 through the opening 14 to the dispensing mechanism 16. The cover 24 may be moved to open/close the opening 14 in order to load the dispensing mechanism 16. A sensor 24A may be positioned on the chamber 16A. The sensor 24A may be used to monitor the amount of grounded smokable tobacco and/or herbs in the chamber 16A. When the level of grounded smokable tobacco and/or herbs in the chamber 16A falls below a desired level, the sensor 24A may signal the cover 24 to open in order to dispense additional grounded smokable tobacco and/or herbs into the chamber 16A.

In order to prevent clumping of the grounded smokable tobacco and/or herbs, the hopper 12 may have a shaking mechanism 26. The shaking mechanism 26 may be coupled to the hopper 12. The shaking mechanism 26 may shake/vibrate the hopper 12. The shaking/vibrating of the hopper 12 may cause the grounded smokable tobacco and/or herbs to move and be dispensed from the hopper 12 out of the openings 14. The shaking/vibrating of the hopper 12 may also cause the continuous movement of the grounded smokable tobacco and/or herbs, thereby preventing the grounded smokable tobacco and/or herbs from clumping and sticking together.

In accordance with one embodiment, the shaking mechanism 26 may be a platform 28 upon which the hopper 12 is attached thereto. The platform 28 may move back and forth, vibrate or the like causing the hopper 12 to move as well. The movement of the hopper 12 may cause the continuous movement of the grounded smokable tobacco and/or herbs thereby dispensing and preventing the grounded smokable tobacco and/or herbs from clumping and sticking together.

After the sensor 22 has signaled the expelling device 16B to stop sending the grounded smokable tobacco and/or herbs down the channel 16C to the container 20, the sensor 22 may signal the dispensing mechanism 18 to unload the container 20. The sensor 22 may signal the dispensing mechanism 18 to dump the grounded smokable tobacco and/or herbs loaded in the container 20 into a loading mechanism 34. The sensor 22 may signal the movable platform 21 to rotate and dispense the grounded smokable tobacco and/or herbs stored in the container 20 into the loading mechanism 34. The loading mechanism 34 may then be used to transfer the grounded smokable tobacco and/or herbs into a pre-rolled cone 46 as will be disclosed below.

The loading mechanism 34 may be used to load individual pre-rolled cones 46 with the grounded smokable tobacco and/or herbs. The loading mechanism 34 may direct the grounded smokable tobacco and/or herbs from the container 20 into an individual pre-rolled cone 46. The loading mechanism 34 may have a funnel device 36. The funnel device 36 may have a head section 38 having an open top area 40. The head area 38 may taper down to a neck section 42. The neck section 42 may be positioned over a pre-rolled cone holder 44 allowing the grounded smokable tobacco and/or herbs to be loaded into a pre-rolled cone 46 positioned in the pre-rolled cone holder 44. In accordance with one embodiment, the pre-rolled cone holder 44 may hold a plurality of pre-rolled cones 46. Once an individual pre-rolled cone 46 is filled, a corresponding pre-rolled cone 46 may be positioned under the loading mechanism 34 in order to be loaded with the grounded smokable tobacco and/or herbs.

In accordance with one embodiment, the pre-rolled cone holder 44 may be formed of a base member 48. In the present embodiment, the base member 48 may be cylindrical in shape. However, this may be shown as an example and should not be seen in a limiting manner. The base member 48 may have a plurality of channels 50 formed therein. In accordance with one embodiment, each channel 50 may be conical in shape. Each channel 50 may extend through the base member 48. The channels 50 may be used to house individual pre-rolled cone 46. Each channel 50 may be configured to hold one pre-rolled cone 46 therein with a closed bottom section of the pre-rolled cone 46 extending out of the corresponding channel 50 and an open end of the pre-rolled cone 46 may extend out of the channel 50 and above a top surface 48A of the base member 48.

The base member 48 may be positioned on a platform 52. In accordance with one embodiment, the base member 48 may be movable on the platform 52. The base member 48 may move in order to position each channel 50 under the loading mechanism 34 in order to load corresponding pre-rolled cones 46 with the grounded smokable tobacco and/or herbs. In the present embodiment, the base member 48 may rotate on the platform 52 in order to position each channel 50 under the loading mechanism 34.

In accordance with one embodiment, the platform 52 may be movable. The moveable platform 52 may serve multiple purposes. For example, moving the platform 52 may allow one to move the base member away from the loading mechanism 34. This may allow the device 10 to form additional operations on the pre-rolled cones 46 which have been filled. Further, moving the platform 52 may allow the device 10 to position each pre-rolled cone 46 under the filling mechanism 34 if the base member 48 is not movable.

The device 10 may have a pre-rolled cone loader 54. The pre-rolled cone loader 54 may be used to load pre-rolled cones 46 in the pre-rolled cone holder 44. The pre-rolled cone loader 54 may have a tube 54A. The tube 54A may be used to store one or more pre-rolled cones 46. In accordance with one embodiment, the tube 54A may hold a plurality of pre-rolled cones 46, wherein adjacent pre-rolled cones 46 are inserted into one another. A dispensing mechanism 54B may cause one of the pre-rolled cones 46 in the tube 54A to be placed in a corresponding channel 50 of the base member 48. In accordance with one embodiment, the dispensing mechanism 54B may pull and place the pre-rolled cones 46 from the tube 54A in a corresponding channel 50 of the base member 48

The device 10 may have a compacting mechanism 56. The compacting mechanism 56 may be used to compact the grounded smokable tobacco and/or herbs in each pre-rolled cone 46. The compacting mechanism 56 may be formed of a rod member 58. The rod member 58 may be coupled to a lifting mechanism 60. The lifting mechanism 60 may raise and lower the rod member 58 within the pre-rolled cone 46 thereby compacting the grounded smokable tobacco and/or herbs in each pre-rolled cone 46.

In accordance with one embodiment, the compacting mechanism 56 may be positioned above the loading mechanism 34. To ensure that the compacting mechanism 56 may be properly positioned above the loading mechanism 34, an alignment device 59 may be used. The alignment device 59 may have an alignment rod 59A. The alignment rod 59A may extend down from the compacting mechanism 56. When properly aligned, the alignment rod 59A may be in axial alignment with an alignment opening 59B formed in the loading mechanism 34. The alignment rod 59A may then be lowered into the alignment opening 59B of the loading mechanism 34 in order to maintain proper alignment of the compacting mechanism 56 above the loading mechanism 34.

The rod member 58 may be aligned with the neck section 42 of the funnel device 36. The rod member 58 may be dimensioned to have a diameter approximately equal to that of the neck section 42. The lifting mechanism 60 may raise and lower the rod member 58 one or more times so that the rod member 58 is lowered through the funnel device 36 down the neck section 42 and into the pre-rolled cone 46. By raising and lowering the rod member 58 into the pre-rolled cone 46, the grounded smokable tobacco and/or herbs in the pre-rolled cone 46 may be compacted. Further, the raising and lowering of the rod member 58 may clean out any grounded smokable tobacco and/or herbs which may be stuck in the neck section 42 of the funnel device 36.

In accordance with one embodiment, the rod member 58 may be a telescopic pole 58A. The telescopic pole 58A may have individual sections. Each successive section of the telescopic pole 58A may have a smaller diameter than the previous individual section. In this embodiment, the lifting mechanism 60 may extend and retract the telescopic pole 58A to compact the grounded smokable tobacco and/or herbs in the pre-rolled cone and to clean out any grounded smokable tobacco and/or herbs which may be stuck in the neck section 42 of the funnel device 36.

The device 10 may have a sealing mechanism 64. The sealing mechanism 64 may be used to close the open end of the pre-rolled cone 46 once the pre-rolled cone 46 has been loaded with the grounded smokable tobacco and/or herbs and compacted. The sealing mechanism 64 may have an arm member 66. A proximate end 66A of the arm 66 may be coupled to a movement device 68. A distal end 66B may have a plurality of prongs 70. The movement device 68 lowers the arm member 66 so that the plurality of prongs 70 engage an outer perimeter area of the open top of the pre-rolled cone 46. As the movement device 68 moves further downward, the prongs 70 push the edges of the open end inward thereby closing the open top of the pre-rolled cone 46 and sealing the grounded smokable tobacco and/or herbs in the pre-rolled cone 46.

The device 10 may have a dispensing mechanism 72. The dispensing mechanism 72 may be used to remove the pre-rolled cone 46 from the pre-rolled cone holder 44 after the pre-rolled cone 46 has been loaded with the grounded smokable tobacco and/or herbs, compacted and sealed.

The foregoing description is illustrative of particular embodiments of the application, but is not meant to be a limitation upon the practice thereof. The following claims, including all equivalents thereof, are intended to define the scope of the application.

What is claimed is:

1. A device for automated loading and forming smoking articles comprising:

a pre-rolled cone holder holding a plurality of pre-rolled cones;

a loading mechanism loading individual pre-rolled cones in the pre-rolled cone holder with a predefined amount of material;

a filling mechanism depositing the predefined amount of material in the loading mechanism, the filling mechanism monitoring an amount of material loaded in the filling mechanism and sending a signal to stop loading the filling mechanism with the material when a predefined amount has been loaded;

a dispensing mechanism sending the material to the filling mechanism, the dispensing mechanism stopping the sending of material when the filling mechanism send the signal to stop loading the filling mechanism with the material when a predefined amount has been loaded;

a hopper in communication with the dispensing mechanism storing the material;

a shaker coupled to the hopper shaking the material in the hopper preventing the material from sticking together; and a sealing mechanism closing an open end of each of the pre-rolled cones preventing the material loaded into each of the pre-rolled cones from falling out, wherein the sealing mechanism comprises:

a movement device;

a single vertical arm member having a proximate end coupled to the movement device and positioned above a corresponding pre-rolled cone to be sealed; and a plurality of angled prong members attached to the single vertical arm member, wherein an angled section of each angled prong member extends away from the single vertical arm so a bottom section of the single vertical member extending down between the angled section of each angled prong member and is untouched by the angled section of each angled prong member, wherein each of the angled prong members engages an outer perimeter of the corresponding pre-rolled cone to be sealed as the single vertical arm member moves downward, each angled prong member pushing the outer perimeter of the corresponding pre-rolled cone inward into an interior of the corresponding pre-rolled cone and a distal end of the single vertical member compacting the outer perimeter of the corresponding pre-rolled cone pushed into the interior to seal an open end of the corresponding pre-rolled cone as the movement device lowers the single vertical arm member in a single downward movement.

2. The device of claim 1, comprising a compacting mechanism compressing the predefined amount of material loaded into each of the pre-rolled cones.

3. The device of claim 1, comprising a pre-rolled cone loader loading the pre-rolled cone holder with the plurality of pre-rolled cones.

4. The device of claim 1, wherein the pre-rolled cone holder comprises:

a base member; and a plurality of channels formed through the base member, wherein each of the plurality of channels is configured to hold an individual pre-rolled cone, wherein a top open section of the individual pre-rolled cone extends above the base member and a bottom closed section of the pre-rolled cone extends below the base member.

5. The device of claim 1, wherein the loading mechanism is a funnel device having a head section having an open top, the head section tapering into a neck section.

6. The device of claim 1, wherein the filling mechanism comprises:

a movable platform;

a container positioned on the movable platform; and a sensor monitoring an amount of material placed in the container;

wherein the sensor signals when a predefined amount of the material is loaded in the container and signals movable platform to dispense the material in the container to the loading mechanism.

7. The device of claim 1, wherein the dispensing mechanism comprises:

a chamber positioned below the hopper and loading the chamber with the material; and an expelling device forcing the material stored in the chamber out of the chamber down a channel and to the filling mechanism, wherein the expelling device uses air to blow the material out of the chamber and into the filling mechanism;

wherein the expelling device is an air piston the air piston blowing compressed air, the compressed air moving the material down the chamber and separating the material so the material does not clump together.

8. The device of claim 2, wherein the compacting mechanism comprises:

a rod member; and a lifting mechanism coupled to the rod member, the lifting member raising and lowering the rod member into a specific pre-rolled cone in the pre-rolled cone holder compacting the predefined amount of material loaded therein.

9. The device of claim 8, wherein the rod member is a telescopic rod member, the lifting mechanism extending and retracting the telescopic rod member.

10. A device for automated loading and forming smoking articles comprising:

a pre-rolled cone holder holding a plurality of pre-rolled cones;

a loading mechanism loading individual pre-rolled cones in the pre-rolled cone holder with a predefined amount of material;

a compacting mechanism compressing the predefined amount of material loaded into each of the pre-rolled cones;

a sealing mechanism compressing an open end of each of the pre-rolled cones preventing the material loaded into each of the pre-rolled cones from falling out, wherein the sealing mechanism comprises:

a movement device;

a vertical arm member having a proximate end coupled to the movement device and positioned above a corresponding pre-rolled cone to be sealed; and a plurality of angled prong members attached to the vertical arm member, wherein an angled section of each angled prong member extends away from the single vertical arm so a bottom section of the single vertical member extends down between the angled section of each angled prong member and is untouched by the angled section of each angled prong member, wherein a bottom angled section of each of the angled prong members engages an outer perimeter of the corresponding pre-rolled cone to be sealed, each angled prong member pushing the outer perimeter of the corresponding pre-rolled cone inward, a distal end of the vertical arm member compacting the outer perimeter of the corresponding pre-rolled cone pushed inwards to seal an open end of the corresponding pre-rolled cone as the movement device lowers the vertical arm member in a single downward motion of the vertical arm member;

a filling mechanism depositing the predefined amount of material in the loading mechanism, the filling mechanism monitoring an amount of material loaded in the filling mechanism and sending a signal to stop loading the filling mechanism with the material when a predefined amount has been loaded; and a dispensing mechanism sending the material to the filling mechanism, the dispensing mechanism stopping the sending of material when the filling mechanism send the signal to stop loading the filling mechanism with the material when a predefined amount has been loaded.

11. The device of claim 10, comprising a hopper in communication with the dispensing mechanism storing the material.

12. The device of claim 11, comprising a shaker coupled to the hopper shaking the material in the hopper preventing the material from sticking together.

13. The device of claim 10, comprising a pre-rolled cone loader loading the pre-rolled cone holder with the plurality of pre-rolled cones.

14. The device of claim 10, wherein the pre-rolled cone holder comprises:

a base member; and a plurality of channels formed through the base member, wherein each of the plurality of channels is configured to hold an individual pre-rolled cone, wherein a top open section of the individual pre-rolled cone extends above the base member and a bottom closed section of the pre-rolled cone extends below the base member.

15. The device of claim 10, wherein the filling mechanism comprises:

a movable platform;

a container positioned on the movable platform;

a sensor monitoring an amount of material placed in the container;

wherein the sensor signals when a predefined amount of the material is loaded in the container and signals movable platform to dispense the material in the container to the loading mechanism.

16. The device of claim 10, wherein the dispensing mechanism comprises:

a hopper;

a chamber positioned below the hopper and loading the chamber with the material; and an expelling device blowing air that forces the material stored in the chamber out of the chamber to the filling mechanism.

17. The device of claim 16, wherein the expelling device is an air piston.

18. The device of claim 10, wherein the compacting mechanism comprises:

a rod member; and a lifting mechanism coupled to the rod member, the lifting member raising and lowering the rod member into a specific pre-rolled cone in the pre-rolled cone holder compacting the predefined amount of material loaded therein.

19. The device of claim 18, wherein the rod member is a telescopic rod member, the lifting mechanism extending and retracting the telescopic rod member.

* * * * *